US008505609B2

(12) United States Patent
Huang

(10) Patent No.: US 8,505,609 B2
(45) Date of Patent: Aug. 13, 2013

(54) SAFETY ASSEMBLY FOR A ROLLER BLIND

(75) Inventor: Wen-Chong Huang, Taipei (TW)

(73) Assignee: K.E. & Kingstone Co., Ltd., Taipei (TW)

( * ) Notice: Subject to any disclaimer, the term of this patent is extended or adjusted under 35 U.S.C. 154(b) by 317 days.

(21) Appl. No.: 13/110,700

(22) Filed: May 18, 2011

(65) Prior Publication Data

US 2012/0255686 A1 Oct. 11, 2012

(30) Foreign Application Priority Data

Apr. 7, 2011 (CN) ..... 2011 1 0091364

(51) Int. Cl.
*E06B 9/56* (2006.01)

(52) U.S. Cl.
USPC ..... 160/293.1; 160/302

(58) Field of Classification Search
USPC ..... 160/242, 291, 293.1, 300–304.1, 160/320, 322, 321, 344; 242/375.2, 385.1; 474/135, 136
See application file for complete search history.

(56) References Cited

U.S. PATENT DOCUMENTS

| | | | | |
|---|---|---|---|---|
| 131,328 | A * | 9/1872 | Binder | 160/242 |
| 5,232,038 | A * | 8/1993 | Buxbaum | 160/308 |
| 8,286,686 | B2 * | 10/2012 | Cannaverde | 160/320 |
| 8,336,598 | B1 * | 12/2012 | Chang | 160/321 |
| 8,376,022 | B2 * | 2/2013 | Lin | 160/321 |
| 2008/0251622 | A1 * | 10/2008 | Randall et al. | 242/375.2 |

* cited by examiner

*Primary Examiner* — David Purol
*Assistant Examiner* — Jeremy Ramsey
(74) *Attorney, Agent, or Firm* — Hershkovitz & Associates, PLLC; Abraham Hershkovitz

(57) ABSTRACT

A safety assembly for a roller blind has a fixing device, a moving device, a flexible element, a rotating device, a hooking device and a bead cord. The fixing device has a base panel, a stopping arm and a reset mount. The moving device is movably connected to the fixing device between the stopping arm and the reset mount. The flexible element is mounted between the reset mount and the moving device to push the moving device to move relative to the fixing device. The rotating device is rotatably mounted on the moving device and has a stopping disc and a rotating disk. The hooking device is mounted securely below the fixing device, the moving device and the rotating device. The bead cord is mounted between the rotating device and the hooking device to allow the rotating device rotating relative to the moving device by pulling the bead cord.

15 Claims, 7 Drawing Sheets

SAFETY ASSEMBLY FOR A ROLLER BLIND

BACKGROUND OF THE INVENTION

1. Field of the Invention

The present invention relates to a safety assembly, and more particularly relates to a safety assembly for a roller blind to improve the safety of the operation of the roller blind.

2. Description of Related Art

Conventional shades or blinds are generally used in the building decoration, include pleated shades, honey combs, roman shades and roller blinds and usually have bead cords to control the expansion or retraction of the shade cloths or the blind cloths.

However, the conventional bead cord is hanged down at a side of the conventional blind, and a person, especially to a child is easily tied by the conventional bead cord to cause accidents. Although a safety device has been provided to hold the conventional bead cord in place, the holding effect of the conventional safety device may be lost when the safety device is broken or invalid or is not mounted on a desired location and this still easily causes accidents.

To overcome the shortcomings, the present invention provides a safety assembly for a roller blind to mitigate or obviate the aforementioned problems.

SUMMARY OF THE INVENTION

The main objective of the present invention is to provide a safety assembly for a roller blind that can be used the roller blind safely.

The safety assembly for a roller blind in accordance with the present invention has a fixing device, a moving device, a flexible element, a rotating device, a hooking device and a bead cord. The fixing device has a base panel, a stopping arm and a reset mount. The moving device is movably connected to the fixing device between the stopping arm and the reset mount. The flexible element is mounted between the reset mount and the moving device to push the moving device to move relative to the fixing device. The rotating device is rotatably mounted on the moving device and has a stopping disc and a rotating disk. The hooking device is mounted securely below the fixing device, the moving device and the rotating device. The bead cord is mounted between the rotating device and the hooking device to make the moving device moving downward to abut and press the flexible element and to enable the stopping disc to separate from the stopping arm and to allow the rotating device rotating relative to the moving device by pulling the bead cord.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
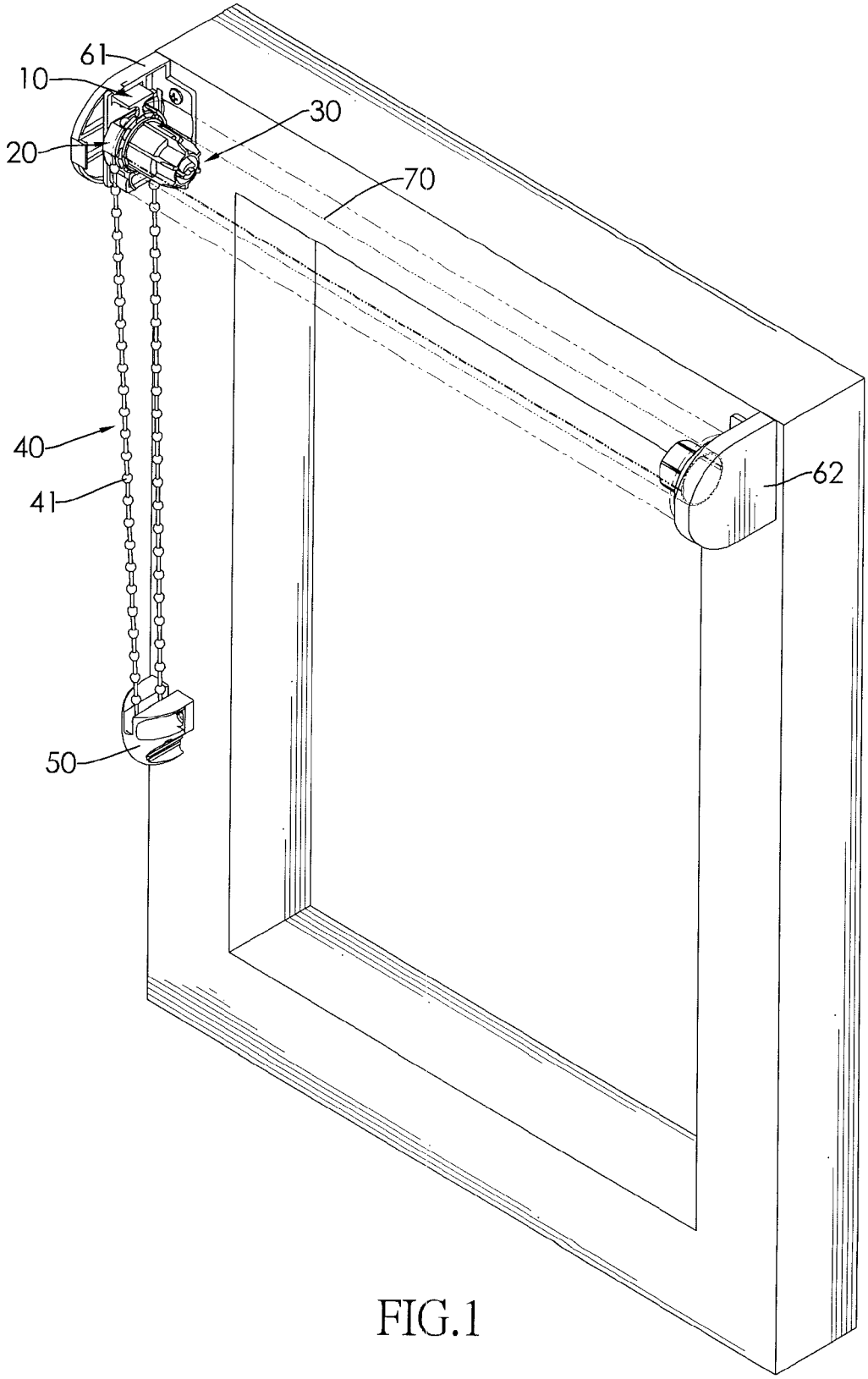
FIG. 1 is a perspective view of a safety assembly for a roller blind in accordance with the present invention mounted on a side of a window frame.
Figure 2:
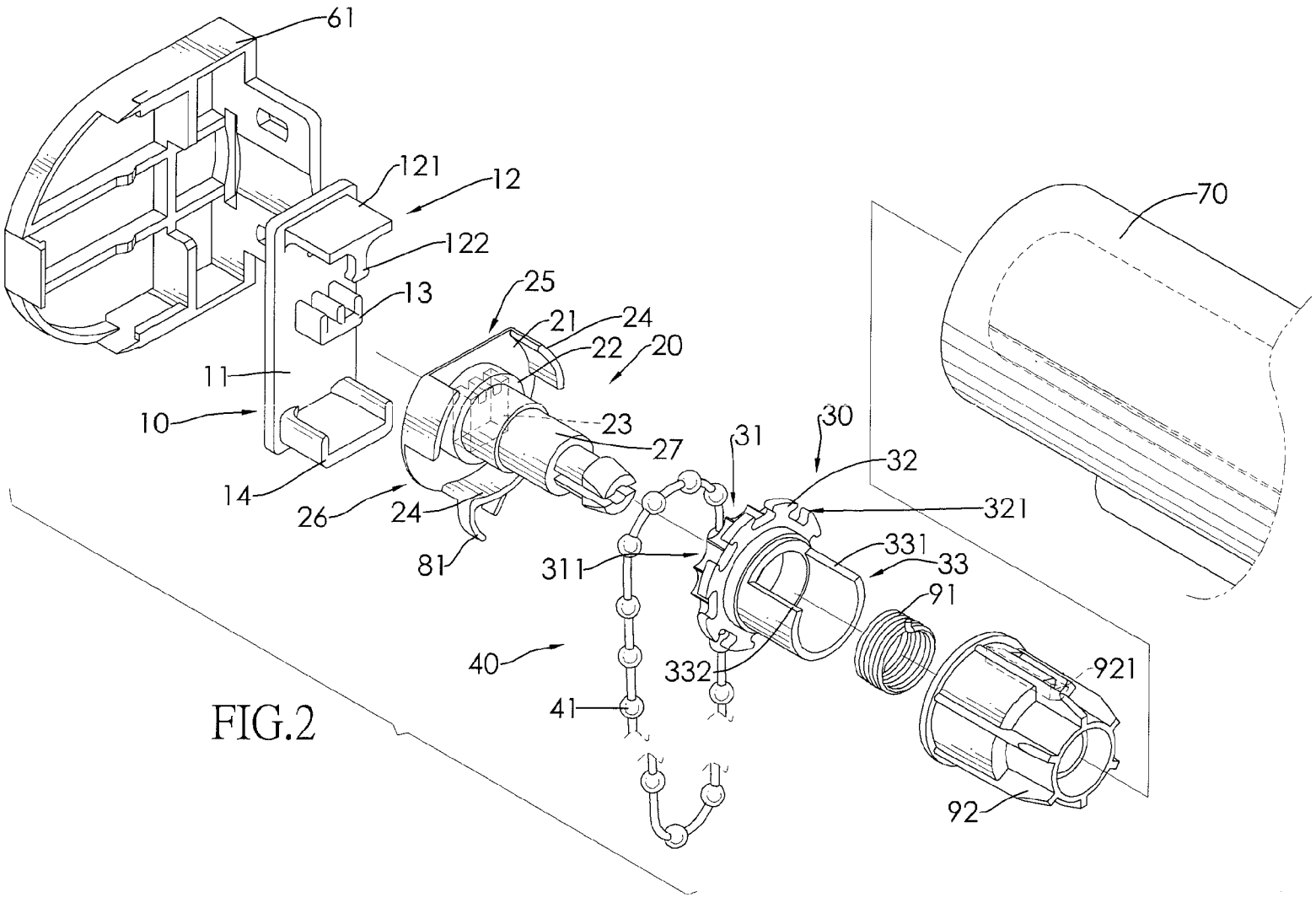
FIG. 2 is an enlarged exploded perspective view of the safety assembly for a roller blind in FIG. 1.
Figure 3:
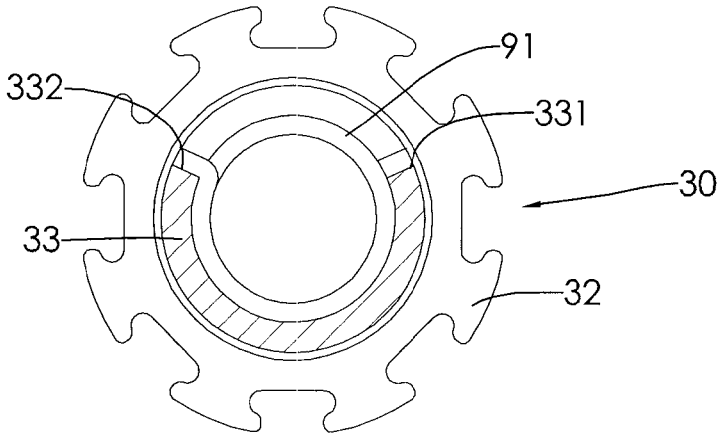
FIG. 3 is an enlarged side view in partial section of a rotating device of the safety assembly for a roller blind in FIG. 2.

With reference to FIGS. 1 to 3, a safety assembly for a roller blind in accordance with the present invention comprises a fixing device 10, a moving device 20, a flexible element, a rotating device 30, a torsional spring 91, a hooking device 50 and a bead cord 40.

The roller blind has a first mounting frame 61, a second mounting frame 62 and a roller 70. The mounting frames 61, 62 are securely mounted on a side of a window frame and face to each other, and each mounting frame 61, 62 has an inner side. The roller 70 is mounted between the inner sides of the mounting frames 61, 62 and has a blind cloth rolled around the roller 70.

The fixing device 10 is mounted in the first mounting frame 61 of the roller blind and has a base panel 11, a stopping arm 12, a positioning mount 13 and a reset mount 14, 14B, 14C, 14D. The base panel 11 is mounted on the inner side of the first mounting frame 61 and has a top, a bottom and an inner surface. The stopping arm 12 is formed on and protrudes from the inner surface of the base panel 11 near the top of the base panel 11 and has an upper panel 121 and a stopping protrusion 122. The upper panel 121 is formed on and protrudes horizontally from the inner surface of the base panel 11 near the top of the base panel 11 and has a free end. The stopping protrusion 122 is formed on and protrudes downward from the free end of the upper panel 121 and has a shape.

The positioning mount 13 is formed on and protrudes from the inner surface of the base panel 11 below the stopping arm 12 and has a height, a top surface, two opposite sidewalls, two limiting faces and multiple positioning protrusions. The limiting faces are respectively formed on the opposite sidewalls of the positioning mount 13. The positioning protrusions are formed on and protrude from the top surface of the positioning mount 13 at intervals. With further reference to FIGS. 2 and 7 to 9, the reset mount 14, 14B, 14C, 14D is formed on and protrudes from the inner surface of the base panel 11 between the positioning mount 13 and the bottom of the base panel 11 and has a top surface.

The moving device 20 is movably connected to the fixing device 10 below the stopping arm 12 and has a mounting panel 21, a positioning recess 23, a central protrusion 22, an annular flange 24, 24B, 24C, 24D, an upper opening 25, two lower openings 26 and a spindle 27. The mounting panel 21 is mounted on the inner surface of the base panel 11 between the stopping arm 12 and the reset mount 14, 14B, 14C, 14D and has an annular surface, an outer side and an inner side. The outer side of the mounting panel 21 abuts the inner surface of the base panel 11. The positioning recess 23 is formed through the outer side of the mounting panel 21, corresponds to the positioning mount 13 and has a top end, two limiting inner sidewalls and a height. The limiting inner sidewalls of the positioning recess 23 respectively abut the limiting faces of the positioning mount 13 to prevent the moving device 20 from rotating with the rotating device 30. The height of the positioning recess 23 is longer than the height of the positioning mount 13 to enable the positioning mount 13 to move upward or downward relative to the positioning recess 23.

The central protrusion 22 is formed on and protrudes from the inner side of the mounting panel 21 and has an inner side. The positioning recess 23 is formed in the central protrusion 22 through the outer side of the mounting panel 21. The annular flange 24, 24B, 24C, 24D is formed on and protrudes from the annular surface of the mounting panel 21 around the central protrusion 22 and has a top and a bottom. The upper opening 25 is formed through the top of the annular flange 24, 24B, 24C, 24D. The tower openings 26 are formed through the annular flange 24, 24B, 24C, 24D between the upper opening 25 and the bottom of the annular flange 24, 24B, 24C, 24D. Preferably, each opening 25, 26 further has a central line that extends through the center of the central protrusion 22 and the angle between the central lines of the upper opening 25 and each one of the lower openings 26 is 60 degrees. The spindle 27 is formed on and protrudes from the inner side of the central protrusion 22.

Figure 5:
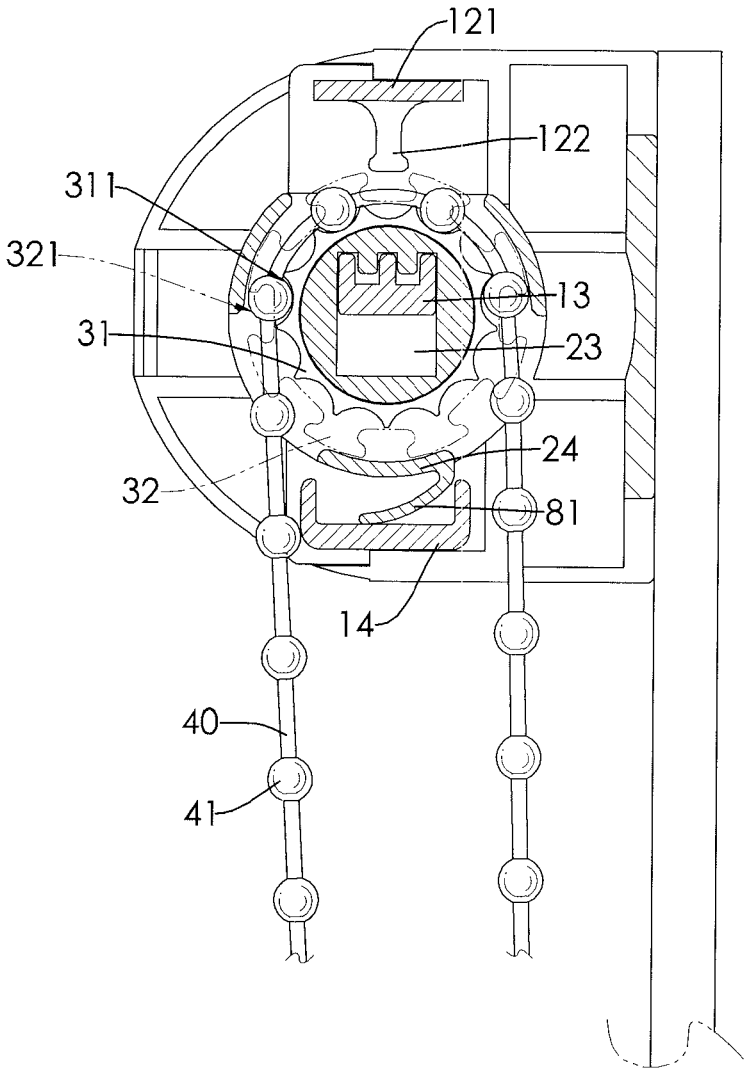
FIG. 5 is an enlarged side view in partial section of a fixing device, a rotating device and a bead cord of the safety assembly for a roller blind in FIG. 2.
Figure 7:
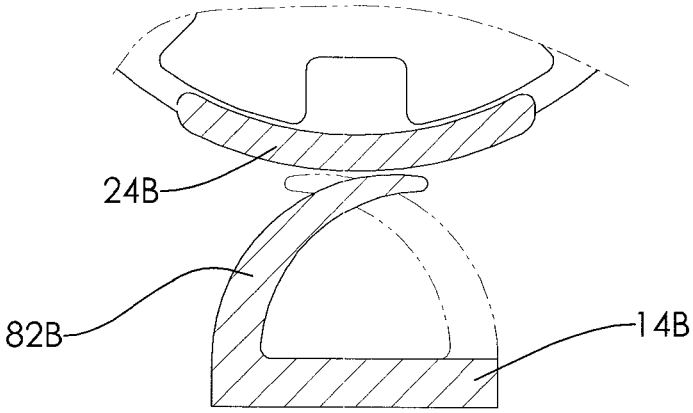
FIG. 7 is an enlarged side view in partial section of a second embodiment of a flexible element of the safety assembly for a roller blind in accordance with the present invention.
Figure 8:
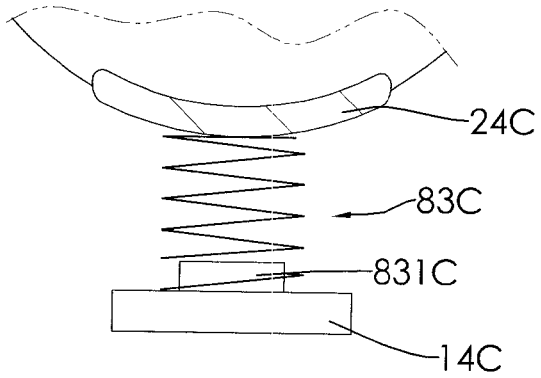
FIG. 8 is an enlarged side view in partial section of a third embodiment of a flexible element of the safety assembly for a roller blind in accordance with the present invention.
Figure 9:
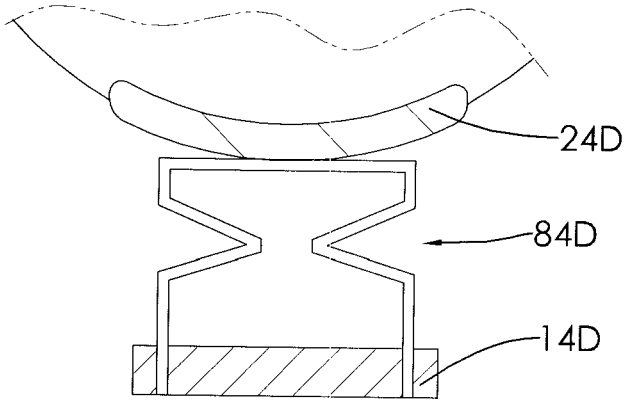
FIG. 9 is an enlarged side view in partial section of a fourth embodiment of a flexible element of the safety assembly for a roller blind in accordance with the present invention.

The flexible element is mounted between the reset mount 14, 14B, 14C, 14D of the fixing device 10 and the moving device 20 to push the moving device 20 to move relative to the fixing device 10. With reference to FIGS. 2 and 5, the flexible element can be two wing panels 81 formed on and protruding downward from the annular flange 24 and misaligning from each other to contact the top surface of the reset mount 14. With reference to FIG. 7, the flexible element can be two wing panels 82B formed on and protruding upward from the top surface of the reset mount 14B and misaligning from each other. With reference to FIG. 8, the flexible element can be a spring 83C mounted on the reset mount 14C and having a mounting rod 831C formed on and protruding from the top surface of the reset mount 14C to hold the spring 83C between the annular flange 24C and reset mount 14C. With reference to FIG. 9, the flexible element can be an elastic sheet 84D mounted on the reset mount 14D and abutting the annular flange 24D.

The rotating device 30 is rotatably mounted on the moving device 20 and has a stopping disc 32, a rotating disk 31, a mounting jacket 33 and a connecting bushing 92. The stopping disc 32 may be circular, is rotatably mounted around the spindle 27 of the moving device 20 and has an outer side, an inner side, a periphery and multiple stopping recesses 321. The outer side of the stopping disc 32 faces the inner side of the mounting panel 21. The stopping recesses 321 are formed radially in the periphery of the stopping disc 32 at intervals, and each stopping recess 321 has a shape corresponding to the shape of the stopping protrusion 122 of the fixing device 10.

With further reference to FIG. 5, the rotating disk 31 may be circular, is formed on and protrudes from the outer side of the stopping disc 32, is mounted around the central protrusion 22 of the moving device 20, is held in the annular flange 24, 24B, 24C, 24D and has a periphery and multiple ball recesses 311. The ball recesses 311 are concave and are formed in the periphery of the rotating disk 31 at intervals.

The mounting jacket 33 is formed on and protrudes from the inner side of the stopping disc 32, is mounted around the spindle 27 of the moving device 20 and has an external surface, a gap, a first abutting edge 331 and a second abutting edge 332. The gap is formed through the external surface of the mounting jacket 33 to form two opposite sides. The abutting edges 331, 332 are respectively defined on the opposite sides of the gap.

The connecting bushing 92 is hollow, is mounted around the mounting jacket 33 and has an internal surface and a rotating rib 921. The rotating rib 921 is formed longitudinally on and protrudes from the internal surface of the connecting bushing 92 between the abutting edges 331, 332 of the mounting jacket 33 to enable the rotating rib 921 to selectively abut one of the abutting edges 331, 332 of the mounting jacket 33. Then, the connecting bushing 92 can be rotated with the mounting jacket 33 in the same rotating direction.

With further reference to FIG. 3, the torsional spring 91 is mounted securely around the spindle 27 in the mounting jacket 33 and has two free ends respectively abutted the abutting edges 331, 332 of the mounting jacket 33.

Figure 4:
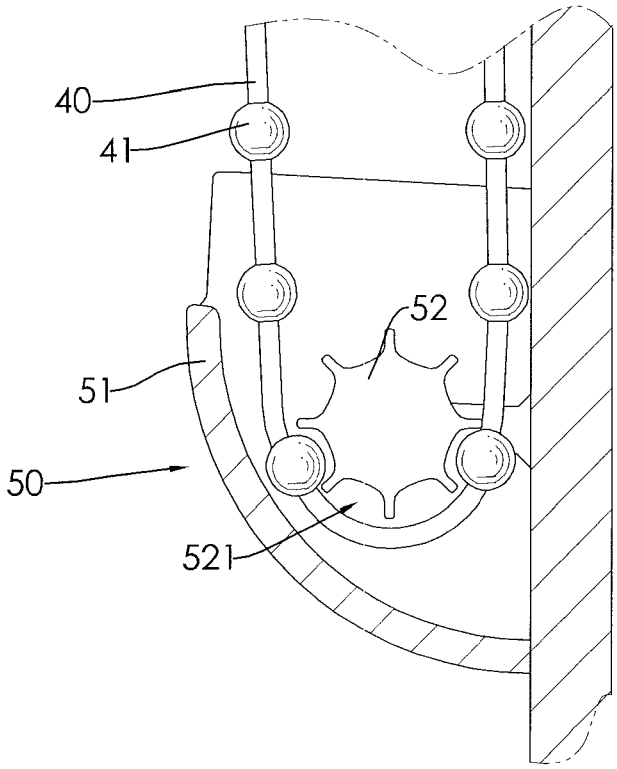
FIG. 4 is an enlarged side view in partial section of a first embodiment of a hooking device of the safety assembly for a roller blind in FIG. 1.

With reference to FIGS. 1, 2 and 4, the hooking device 50 is mounted securely on the side of the window frame below the fixing device 10, the moving device 20 and the rotating device 30. Preferably, the hooking device 50 has a casing 51 and a rotating panel 52. The casing 51 is mounted securely on the side of the window frame and has a top, a chamber and an opening. The top of the casing 51 faces the fixing device 10, the moving device 20 and the rotating device 30. The chamber is formed in the casing 51. The opening is formed through the top of the casing 51 and communicates with the chamber of the casing 51. The rotating panel 52 is rotatably mounted in the chamber of the casing 51 and has a periphery and multiple ball recesses 521. The ball recesses 521 are formed in the periphery of the rotating panel 52 at intervals and each ball recess 521 has a shape corresponding to the shape of the ball recess 311 of the rotating disk 31.

The bead cord 40 is endless, is mounted between the rotating device 30 and the hooking device 50 and has a cord and multiple balls 41. The cord is mounted around rotating disk 31 and the rotating panel 51 via the lower openings 26 and the opening of the casing 51. The balls 41 are mounted securely around the cord of the bead cord 40 at intervals and are selectively mounted in the ball recesses 311, 521 of the rotating disk 31 and the rotating panel 52.

In assembling, with reference to FIGS. 1, 2 and 5, the fixing device 10, the moving device 20, the rotating device 30 and the bead cord 40 are connected to the first mounting frame 61 and the first mounting frame 61 is mounted securely on a side of a window frame to enable the connecting bushing 92 to mount securely in one end of the roller 70. The second mounting frame 62 is mounted securely on the side of the window frame and is rotatably connected to the other end of the roller 70.

At this time, the hooking device 50 is pulled downward to enable the rotating device 30 and the moving device 20 to move downward relative to the fixing device 10 by the bead cord 40 that engages the rotating disk 31. Then, the limiting inner sidewalls of the positioning recess 23 will move downward relative to the positioning mount 13 along the limiting faces of the positioning mount 13 to make the positioning protrusions of the positioning mount 13 abut the top end of the positioning recess 23.

When the positioning protrusions of the positioning mount 13 abut the top end of the positioning recess 23, the hooking device 50 is fixed securely on the side of the window frame to enable the moving device 20 to move downward relative to the fixing device 10 and to enable the stopping recesses 321 of the stopping disc 32 to be separated from the stopping protrusion 122 of the stopping arm 12 as shown in FIG. 5 and the flexible element will be compressed between the annular flange 24, 24B, 24C, 24D and the reset mount 14, 14B, 14C, 14D as shown in FIGS. 5 and 7 to 9. In the above mentioned condition, the stopping recesses 321 of the stopping disc 32 disengage from the stopping protrusion 122 of the stopping arm 12, and the bead cord 40 can be pulled downward to rotate the rotating device 30 relative to the moving device 20 to draw the blind cloth of the roller 70 by the engagement between the balls 41 and the ball recesses 311, 521 of the rotating disk 31 and the rotating panel 52. In addition, the bead cord 40 is held between the rotating device 30 and the hooking device 50 and this can prevent child from easily tiding by the bead cord 40.

Figure 6:
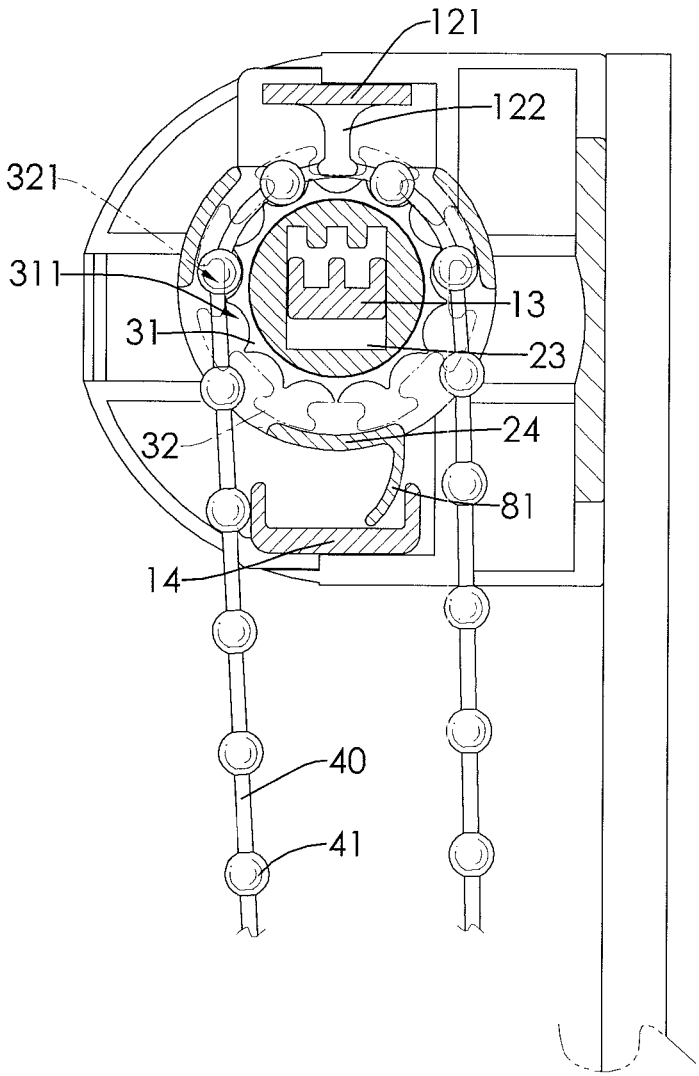
FIG. 6 is an operational side view in partial section of the safety assembly for a roller blind in FIG. 5.

Furthermore, with reference to FIGS. 1, 3 and 6, when the bead cord 40 is separated from the hooking device 50, the pressed flexible element between the annular flange 24, 24B, 24C, 24D and the reset mount 14, 14B, 14C, 14D will push the moving mount 20 and the rotating device 30 to move upward relative to the fixing device 10 and to enable one of the stopping recesses 321 of the stopping disc 32 to engage the stopping protrusion 122 of the stopping arm 12. Then, the separated bead cord 40 cannot rotate the rotating device 30 relative to the fixing device 10 and the blind cloth of the roller 70 cannot be drawn by the bead cord 40 and this can provide a safe operation to the roller blind when the bead cord 40 is not fixed by the hooking device 50. Therefore, even if the hooking device 50 is broken or invalid or is not mounted on a desired location, the bead cord 40 cannot be rotated and the blind cloth of the roller 70 cannot be drawn relative to the window frame by the bead cord 40 and this can improve the safety of the operation of the roller blind.

During the above mentioned operation of the safety assembly for a roller blind in accordance with the present invention, the limiting inner sidewalls of the positioning recess 23 respectively abut the limiting faces of the positioning mount 13 and the height of the positioning recess 23 is longer than that of the positioning mount 13, the moving device 20 can be kept from rotating relative to the rotating device 30 and the moving device 20 is allowed to move upward or downward relative to the fixing device 10. In addition, the blind cloth of the roller 70 can be drawn by the bead cord 40 with the engagement between the balls 41 of the bead cord 40 and the balls recesses 311 of the rotating disk 31 and the rotating panel 52 is rotatably connected to the casing 51 and has multiple ball recesses 521 engaging the balls 41 of the bead cord 40 and the bead cord 40 can be operated conveniently to draw the blind cloth of the roller 70 by pulling the bead cord 40.

Furthermore, the torsional spring 91 is mounted securely around and abuts securely the spindle 27 and the moving device 20 is movably connected to the fixing device 10, the torsional spring 91 cannot be rotated with the rotating device 30 without an external force. When the bead cord 40 is pulled to expand the blind cloth of the roller 70, the rotating device 30 is rotated with the bead cord 40, the user's pulling force is larger than the pressing force between the first abutting edge 331 of the mounting jacket 33 and the corresponding free end of the torsional spring 91, and this will make the torsional spring 91 loosening and being released from the spindle 27 and rotating relative to the spindle 27. Then, the blind cloth of the roller 70 can be drawn down by the bead cord 40.

In addition, when the user pulls the bead cord 40 to draw blind cloth of the roller 70 up at an opposite direction, the user's pulling force is larger than the pressing force between the second abutting edge 332 of the mounting jacket 33 and the corresponding free end of the torsional spring 91, and this will make the torsional spring 91 loosening and being released from the spindle 27 and rotating relative to the spindle 27. Then, the blind cloth of the roller 70 can be drawn up by the bead cord 40. Furthermore, when the blind cloth of the roller 70 is set at any height relative to the window frame, the elastic force of the torsional spring 91 is large enough to against the weight of the blind cloth of the roller 70 and this can prevent the blind cloth of the roller 70 from moving down in unused.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety assembly for a roller blind having a first mounting frame mounted on a side of a window frame with an inner side, a second mounting frame mounted on the side of the window frame and having an inner side and a roller mounted between the inner sides of the mounting frames, with a blind cloth rolled around the roller, and the safety assembly comprising:

a fixing device being adapted to be mounted in the first mounting frame and having a base panel being adapted to mount on the inner side of the first mounting frame and having a top, a bottom and an inner surface;

a stopping arm formed on and protruding from the inner surface of the base panel near the top of the base panel; and a reset mount formed on and protruding from the inner surface of the base panel between the stopping arm and the bottom of the base panel and having a top surface;

a moving device movably connected to the fixing device between the stopping arm and the reset mount;

a flexible element mounted between the reset mount of the fixing device and the moving device to push the moving device to move relative to the fixing device;

a rotating device rotatably mounted on the moving device and having a stopping disc rotatably mounted on the moving device and having an outer side facing the moving device; and an inner side; and a rotating disk formed on and protruding from the outer side of the stopping disc and mounted on the moving device;

a hooking device being adapted to mount securely on the side of the window frame and located below the fixing device, the moving device and the rotating device; and a bead cord being endless, mounted between the rotating disc of the rotating device and the hooking device to make the moving device move downward to abut and press the flexible element and to enable the stopping disc of the rotating device to separate from the stopping arm of the fixing device and to allow the rotating device to rotate relative to the moving device by pulling the bead cord.

2. The safety assembly for a roller blind as claimed in claim 1, wherein the moving device has a mounting panel mounted on the inner surface of the base panel between the stopping arm and the reset mount and having an annular surface;

an outer side abutting the inner surface of the base panel; and an inner side;

a central protrusion formed on and protruding from the inner side of the mounting panel and having, an inner side; and a spindle formed on and protruding from the inner side of the central protrusion;

the stopping disc is rotatably mounted around the spindle of the moving device;

the rotating disk is mounted around the central protrusion of the moving device; and the rotating device has a mounting jacket formed on and protruding from the inner side of the stopping disc and mounted around the spindle of the moving device.

3. The safety assembly for a roller blind as claimed in claim 2, wherein the stopping arm has an upper panel formed on and protruding horizontally from the inner surface of the base panel near the top of the base panel and having a free end; and a stopping protrusion formed on and protruding downward from the free end of the upper panel and having a shape; and the stopping disc is circular and has a periphery; and multiple stopping recesses formed radially in the periphery of the stopping disc at intervals and each stopping recess having a shape corresponding to the shape of the stopping protrusion of the fixing device.

4. The safety assembly for a roller blind as claimed in claim 1, wherein the rotating disc is circular and has a periphery; and multiple ball recesses being concave and formed in the periphery of the rotating disk at intervals; and the bead cord has a cord mounted around the rotating disk and the hooking device; and multiple balls mounted securely around the cord of the bead cord at intervals and selectively mounted in the ball recesses of the rotating disk and the hooking device.

5. The safety assembly for a roller blind as claimed in claim 3, wherein the rotating disc is circular and has a periphery; and multiple ball recesses being concave and formed in the periphery of the rotating disk at intervals; and the bead cord has a cord mounted around rotating disk and the hooking device; and multiple balls mounted securely around the cord of the bead cord at intervals and selectively mounted in the ball recesses of the rotating disk and the hooking device.

6. The safety assembly for a roller blind as claimed in claim 2, wherein the mounting jacket has an external surface;

a gap formed through the external surface of the mounting jacket to form two opposite sides;

a first abutting edge defined on one of the opposite sides of the gap; and a second abutting edge defined on the other opposite side of the gap; and the safety assembly has at least one torsional spring mounted securely around the spindle in the mounting jacket and said at least one torsional spring having two free ends respectively abutting the abutting edges of the mounting jacket.

7. The safety assembly for a roller blind as claimed in claim 5, wherein the mounting jacket has an external surface;

a gap formed through the external surface of the mounting jacket to form two opposite sides;

a first abutting edge defined on one of the opposite sides of the gap; and a second abutting edge defined on the other opposite side of the gap; and the safety assembly has at least one torsional spring mounted securely around the spindle in the mounting jacket and said at least one torsional spring having two free ends respectively abutted the abutting edges of the mounting jacket.

8. The safety assembly for a roller blind as claimed in claim 2, wherein the fixing device has a positioning mount formed on and protruding from the inner surface of the base panel between the stopping arm and the reset mount and having a height;

a top surface;

two opposite sidewalls;

two limiting faces respectively formed on the opposite sidewalls of the positioning mount; and multiple positioning protrusions formed on and protruding from the top surface of the positioning mount at intervals; and the moving device has a positioning recess formed through the outer side of the mounting panel, formed in the central protrusion and corresponding to the positioning mount and having a top end;

two limiting inner sidewalls respectively abutting the limiting faces of the positioning mount to prevent the moving device from rotating relative to the rotating device; and a height of the positioning recess being longer than the height of the positioning mount to enable the positioning mount to move upward or downward relative to the positioning recess.

9. The safety assembly for a roller blind as claimed in claim 7, wherein the fixing device has a positioning mount formed on and protruding from the inner surface of the base panel between the stopping arm and the reset mount and having a height;

a top surface;

two opposite sidewalls;

two limiting faces respectively formed on the opposite sidewalls of the positioning mount; and multiple positioning protrusions formed on and protruding from the top surface of the positioning mount at intervals; and the moving device has a positioning recess formed through the outer side of the mounting panel, formed in the central protrusion and corresponding to the positioning mount and having a top end;

two limiting inner sidewalls respectively abutting the limiting faces of the positioning mount to prevent the moving device from rotating relative to the rotating device; and a height of the positioning recess being longer than the height of the positioning mount to enable the positioning mount to move upward or downward relative to the positioning recess.

10. The safety assembly for a roller blind as claimed in claim 4, wherein the hooking device has a casing being adapted to mount securely on the side of the window frame and having a top facing the fixing device, the moving device and the rotating device;

a chamber formed in the casing; and an opening formed through the top of the casing and communicating with the chamber of the casing; and a rotating panel rotatably mounted in the chamber of the casing and having a periphery; and multiple ball recesses formed in the periphery of the rotating panel at intervals and each ball recess having a shape corresponding to the shape of the ball recess of the rotating disk; and the balls of the bead cord are selectively mounted in the ball recesses of the rotating disk and the rotating panel.

11. The safety assembly for a roller blind as claimed in claim 9, wherein the hooking device has a casing being adapted to mount securely on the side of the window frame and having a top facing the fixing device, the moving device and the rotating device;

a chamber formed in the casing; and an opening formed through the top of the casing and communicating with the chamber of the casing; and a rotating panel rotatably mounted in the chamber of the casing and having a periphery; and multiple ball recesses formed in the periphery of the rotating panel at intervals and each ball recess having a shape corresponding to the shape of the ball recess of the rotating disk; and the balls of the bead cord are selectively mounted in the ball recesses of the rotating disk and the rotating panel.

12. The safety assembly for a roller blind as claimed in claim 11, wherein the moving device has an annular flange formed on and protruding from the annular surface of the mounting panel and around the central protrusion and having a top and a bottom;

an upper opening formed through the top of the annular flange; and two lower openings formed through the annular flange between the upper opening and the bottom of the annular flange;

the cord of the bead cord is mounted around rotating disk and the rotating panel via the lower openings and the opening of the casing; and the flexible element has two wing panels formed on and protruding downward from the annular flange between the lower openings to contact the top surface of the reset mount.

13. The safety assembly for a roller blind as claimed in claim 11, wherein the moving device has an annular flange formed on and protruding from the annular surface of the mounting panel and around the central protrusion and having a top and a bottom;

an upper opening formed through the top of the annular flange; and two lower openings formed through the annular flange between the upper opening and the bottom of the annular flange;

the cord of the bead cord is mounted around rotating disk and the rotating panel via the lower openings and the opening of the casing; and the flexible element has two wing panels formed on and protruding upward from the top surface of the reset mount to contact the annular flange between the lower openings.

14. The safety assembly for a roller blind as claimed in claim 11, wherein the moving device has an annular flange formed on and protruding from the annular surface of the mounting panel and around the central protrusion and having a top and a bottom;

an upper opening formed through the top of the annular flange; and two lower openings formed through the annular flange between the upper opening and the bottom of the annular flange;

the cord of the bead cord is mounted around rotating disk and the rotating panel via the lower openings and the opening of the casing; and the flexible element has a mounting rod formed on and protruding from the top surface of the reset mount and a spring mounted around the mounting rod to contact with the top surface of the reset mount and the annular flange between the lower openings.

15. The safety assembly for a roller blind as claimed in claim 11, wherein the moving device has an annular flange formed on and protruding from the annular surface of the mounting panel and around the central protrusion and having a top and a bottom;

an upper opening formed through the top of the annular flange; and two lower openings formed through the annular flange between the upper opening and the bottom of the annular flange;

the cord of the bead cord is mounted around rotating disk and the rotating panel via the lower openings and the opening of the casing; and the flexible element has an elastic sheet mounted on the reset mount to abut the annular flange between the lower openings.

* * * * *